US005724770A

United States Patent [19]

McAfee

[11] Patent Number: 5,724,770

[45] Date of Patent: Mar. 10, 1998

[54] SLIDING DOOR TOP GUIDE AND BOTTOM BRACKET ASSEMBLY

[76] Inventor: Thomas H. McAfee, 3302 Rossmoor Way, Los Alamitos, Calif. 90740

[21] Appl. No.: 745,954

[22] Filed: Nov. 8, 1996

[51] Int. Cl.[6] ..... E05D 13/00

[52] U.S. Cl. ..... 49/409; 49/425; 49/404

[58] Field of Search ..... 49/404, 409, 410, 49/411, 501, 425, 417

[56] References Cited

U.S. PATENT DOCUMENTS

| | | | |
|---|---|---|---|
| 1,612,443 | 12/1926 | Johnson et al. . | |
| 3,650,071 | 3/1972 | Tanner | 49/411 |
| 3,750,337 | 8/1973 | Brydolf et al. . | |
| 4,099,599 | 7/1978 | Randall | 49/409 X |
| 4,123,874 | 11/1978 | Scott . | |
| 4,193,500 | 3/1980 | Scott . | |
| 4,631,894 | 12/1986 | Jerila . | |
| 4,799,529 | 1/1989 | McAfee . | |
| 4,803,809 | 2/1989 | Takemura | 49/404 |
| 4,819,297 | 4/1989 | Jacobs et al. . | |
| 4,850,145 | 7/1989 | McAfee . | |
| 4,884,371 | 12/1989 | Gagnon . | |
| 4,887,394 | 12/1989 | Marlowe | 49/409 |

*Primary Examiner*—Jerry Redman

*Attorney, Agent, or Firm*—Fulwider Patton Lee & Utecht, LLP

[57] ABSTRACT

A top guide assembly for connection to a sliding door formed of a panel, a pair of horizontal rails, and a pair of vertical stiles. The top guide assembly comprises a pair of bracket assemblies connected generally to the upper corners of the sliding door. A top guide is provided and includes a vertical stem slidably engaged with the respective bracket assemblies, and a follower assembly is mounted on the top of the stem, is sized for making a close fit within the upper track and includes at least one deflectable tab for ensuring two point contact with the inner wall of the upper track during movement of the sliding door. A pair of bottom bracket assemblies are also provided and are connected to the sliding door adjacent the lower corners thereof. Each such assembly is formed with a downwardly opening channel which slidable receives therein a wheel mount which rotatably mounts at the lower end thereof a wheel for rolling engagement with the lower track.

17 Claims, 1 Drawing Sheet

SLIDING DOOR TOP GUIDE AND BOTTOM BRACKET ASSEMBLY

BACKGROUND OF THE INVENTION

1. Field of the Invention

The present invention relates to sliding doors and, more particularly, to corner connectors for such doors which serve as door guides and supports.

2. Description of the Prior Art

Sliding doors made of relatively lightweight panels have become quite popular for use as sliding wardrobe doors or closet doors in homes, apartments, and the like. Such doors are typically formed of a rectangular mirrored glass or decorative wood panel framed by horizontal upper and lower rails at the top and bottom of the panel, and by vertical stiles at the respective sides of the panel. In a typical installation, two pairs of horizontal tracks are provided, one pair being disposed along the floor and another pair being connected to the lintel. Thus, a pair of such sliding doors ride in the upper and lower pairs of tracks and may pass by each other.

A common mounting arrangement incorporates wheels at the upper corners of the door which ride in the upper track. In such a configuration, the upper track is formed with an upwardly opening channel shaped housing or the like in which the wheels ride. Forms of such assemblies are disclosed in U.S. Pat. Nos. 4,193,500 to Scott, 4,819,297 to Jacobs et al., and 3,750,337 to Brydolf et al. Thus the door is suspended from the upper track and the wheels must support the weight of the door from such upper track. In this arrangement, a conventional guide is included at each lower corner of the door and projects downwardly from the bottom edge of the door to ride in the bottom track in effort to maintain the door in the proper upright orientation during movement thereof along the length of the track.

While satisfactory for sliding doors which are relatively lightweight, such an arrangement is not preferred for more massive doors, as the force which would be applied to the upper track could, over time, cause the upper track to become disconnected from the lintel, thus necessitating repair or replacement of the sliding door assembly.

Thus, the type of assembly more commonly used on heavier doors includes rollers at the bottom corners of the door which ride in the lower track mounted on the floor and which support the weight of the door. Guides are provided at the upper corners of the door and are received in the upper track to slide therein and maintain the sliding door in its vertical orientation.

Such assemblies disclosed in the prior art are not free from shortcomings, however. In many such assemblies, the upper guide is formed having a predetermined cross-sectional configuration to intentionally provide a gap between the peripheral edges of the guide and the inner wall of the upper track to allow for ease of movement of the door along the track. This can result in an annoying and irritating rattle as the door is moved along the track. If the lower track is not perfectly straight, the wheels riding in the lower track will cause the panel to vibrate during movement of the door which can result in the upper guide alternately impacting against the opposite inner walls of the upper track thereby causing an undesirable noise which may awaken or disturb persons asleep in the room.

A top guide has been proposed which includes deflectable arms to maintain contact between the top guide and the inner walls of the upper track while the door is moved along the length of the track, even though the internal diameter of the upper track may vary slightly along the longitudinal length thereof. A form of such assembly is disclosed in U.S. Pat. No. 4,850,145, invented by the inventor of the present invention. While having excellent operating characteristics, such a device is relatively expensive to manufacture and provides no means for adjusting the degree of extension of the top guide from the bracket to which it is engaged to accommodate different degrees of spacing between the upper and lower track.

As such, it will be appreciated that there continues to be a need for a top guide which allows for the door to be moved with relative ease while damping or eliminating rattle of the door. In addition, there continues to be a need for such a top guide which may be readily extended from the upper end of the door for receipt in upper tracks of varying heights relative to the lower track. The present invention addresses such needs and others.

SUMMARY OF THE INVENTION

Briefly, and in general terms, the present invention comprises a top guide assembly for connection to a sliding door including a panel, a pair of horizontal rails, and a pair of vertical stiles. The top guide assembly comprises a pair of bracket assemblies, each such assembly including a bracket housing connected to the panel, the upper rail, and to a respective vertical stile to securely interconnect such members. A top guide is provided and includes a vertical stem slidably engaged with the respective bracket housings. A follower assembly is mounted on the top of the stem and includes a body sized for making a close fit within the upper track. Formed on one side of the body and extending generally horizontally outwardly therefrom is at least one deflectable tab for ensuring two point contact with the inner wall of the upper track during movement of the sliding door along the track.

A pair of bottom bracket assemblies are also provided and are connected to the panel adjacent the respective lower corners thereof. Each such assembly is formed with a downwardly opening channel which slidably receives therein a wheel mount which rotatably mounts at the lower end thereof a wheel for rolling engagement with the lower track.

Other features and advantages of the present invention will become apparent from the following detailed description, taken in conjunction with the accompanying drawings which illustrate, by way of example, the features of the invention.

DETAILED DESCRIPTION OF THE PREFERRED EMBODIMENT

Figure 1:
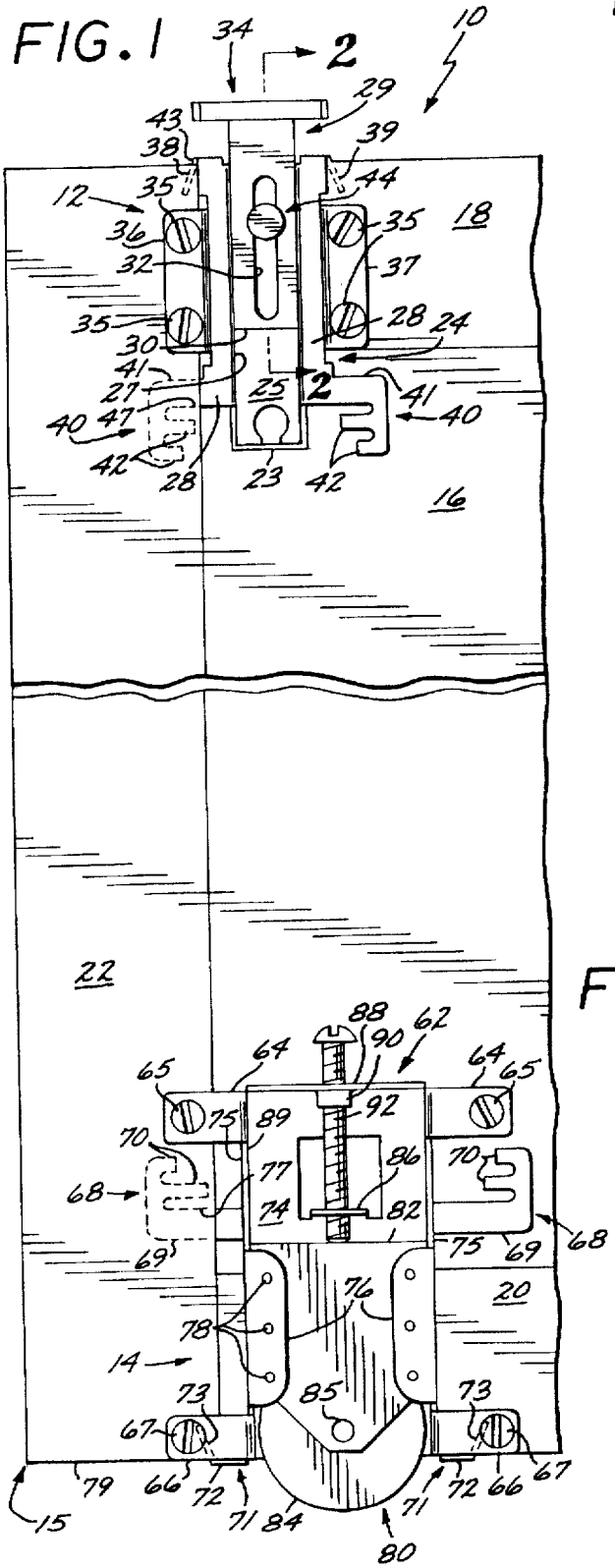
FIG. 1 is a front view of a sliding door top guide and bottom bracket assembly embodying the present invention and mounted on a sliding door.

In the following detailed description, like reference numerals will be used to refer to like or corresponding elements in the different figures of the drawings. Referring now to the drawings, and particularly to FIG. 1, there is shown, generally, a sliding door top guide and bottom bracket assembly 10 embodying the present invention. The top guide and bottom bracket assembly comprises, generally, a top corner connector 12 and bottom corner connector 14 securely connected to a sliding door 15 adjacent the respective upper and lower corners thereof.

The sliding door 15 comprises a planar panel 16 connected at its upper and lower ends to a pair of horizontal rails 18 and 20. The panel is connected at one side thereof to a vertical stile 22. While not shown in the drawings, it will be appreciated that the other side of the panel is also connected to a vertical stile, and that the respective stiles and rails define a peripheral frame for the sliding door.

The rails 18 and 20 are preferably formed of sheet metal roll formed to define an internal, outwardly opening channel (not shown) sized for gripping engagement with the respective top and bottom edges of the panel 16. The resilience of the sheet metal material and the predetermined width of the channel result in the upper and lower edges of the panel being securely engaged by the respective rails.

As with the rails, the vertical stile 22 is preferably formed of sheet metal roll formed to define an outwardly opening, longitudinal channel (not shown) which is sized to grippingly engage the adjacent side edge of the panel and, due to the resilience of the sheet metal and width of the channel, securely engages and holds the side edge of the panel therein.

Thus the rails 18 and 20 and stiles 22 define a rectangular frame securely connected to the panel 16 about the periphery thereof. The respective rails and stiles are interconnected at their respective ends by a pair of top corner connector assemblies 12 and a pair of bottom corner connector assembles 14 of the present invention as will now be described in greater detail.

Although only one top corner connector 12 and bottom corner connector 14 is shown in the figures, it will be appreciated that, in assembling a sliding door, two such top corner connectors and two bottom corner connectors will typically be used and will be disposed adjacent the respective upper and lower corners of the sliding door assembly.

Figure 4:
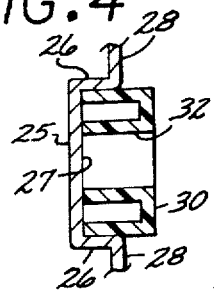
FIG. 4 is a fragmented cross-sectional view taken along the line 4—4 of FIG. 2.

The top corner connector 12 comprises a bracket housing, generally designated 24, including a substantially planar, elongated back wall 25 for placement against the panel 16 and upper rail 18 (FIGS. 1 and 4). Connected to the opposite lateral sides of the back wall are a pair of outwardly projecting, elongated side walls 26 (FIG. 4) which then turn and flare laterally outwardly to define respective outwardly projecting longitudinal wings 28. The back wall and respective side walls cooperate to define an outwardly and upwardly opening channel 27 for slidable receipt therein of a top guide assembly, generally designated 29, as described in greater detail below.

The back wall 25 is further formed at its bottom end with an outwardly extending flange 23 connected to the bottom ends of the respective side walls 26 to close off the bottom end of the channel 27.

The respective out-turned wings 28 have formed generally medially thereon a pair of outwardly extending mounting flanges 36 and 37. The mounting flanges are formed with respective pairs of longitudinally spaced apart mounting bores (not shown) for receipt of respective screws 35 to mount the top corner connector 12 to the sliding door assembly. The mounting flange 36 overlies the vertical stile 22 in registration with a pair of apertures formed in predetermined locations in the stile (not shown). Likewise, a pair of threaded bores are formed in predetermined positions in the panel 16 for registration with the respective mounting bores and apertures. Thus the screws not only serve to connect the mounting flange 36 and stile 22 together, but also fixedly connect the stile and panel together.

The mounting flange 37 overlies the upper rail 18 in registration with a pair of apertures (not shown) formed in predetermined positions in the rail. Similarly, a second pair of threaded bores (not shown) are formed in predetermined positions in the panel 16 for registration with the respective mounting bores formed in the flange 37 and apertures in the rail. Thus the screws 35 serve to engage the flange 37 and upper rail 18 and also fixedly connect the upper rail and panel together. As such, it will be appreciated that the top corner connectors serve to positively interconnect the panel, upper rail and respective stiles together.

The respective out-turned wings 28 terminate at their upper longitudinal ends in respective laterally outwardly and downwardly angling anchor tabs 38 and 39 (FIG. 1). The anchor tab 38 is received in the open upper end 43 of the stile 22 and the anchor tab 39 is received in a transverse slot 45 formed in the upper end of the upper rail 18. Thus the respective anchor tabs provide a further means for securely coupling the stile, upper rail and panel together.

The back wall 25 may be formed at its upper end with a similarly configured anchor tab (not shown) including a rearwardly projecting segment connected at its distal end to a downwardly projecting tab for telescopical extension through a longitudinal slot (not shown) formed at a predetermined location in the upper rail 18 to still further interconnect the panel 16, upper rail and stile 22.

The respective out-turned wings 28 terminate at their lower ends in laterally outwardly extending, generally E-shaped clips, generally designated 40. The clips include respective arms 41 which project laterally outwardly and then turn and project downwardly. Connected to the arms along the downwardly projecting segments thereof are respective pairs of spaced apart, resilient, laterally inwardly projecting curved anchor clip fingers 42. As shown in FIG. 1, an aperture 47 is formed in the inwardly facing side wall of the stile for extension therethrough of the clip. The curved clip fingers are resilient so as to flex when being inserted through the aperture. Once the fingers have passed through the aperture and are disposed within the hollow interior of the stile, the resilience of such fingers causes such fingers to resume their normal curved configuration and engage the inner margin of the stile aperture 47 to securely connect the top corner connector 12 to the stile. In the event it becomes necessary to remove the top corner connector, a user may insert a screwdriver or the like through the open upper end 43 of the stile to manipulate the clip fingers out of engagement with the stile aperture margin so that the clip may be removed from the aperture.

It will be appreciated that the top corner connector 12 is formed symmetrically so that such connector may be used in either the upper right or upper left corner to interconnect the stile 22, upper rail 18 and panel 16. As shown in FIG. 1, the clip 40 which projects laterally outwardly to the right serves no purpose when the corner connector is mounted in the upper left corner of the sliding door assembly. It will be appreciated, however, that such clip would be inserted in an aperture formed in the stile were the connector instead mounted in the upper right corner of the sliding door assembly. Similarly, the anchor tab 39 would be inserted into the open upper end of the stile, while the anchor tab 38 would be inserted in a slot formed at a predetermined location in the upper wall of the upper rail 18. As such, the top corner connector is symmetrically designed for mounting in either upper corner of a door assembly and thus eliminates the need to manufacture two different connectors.

Figure 2:
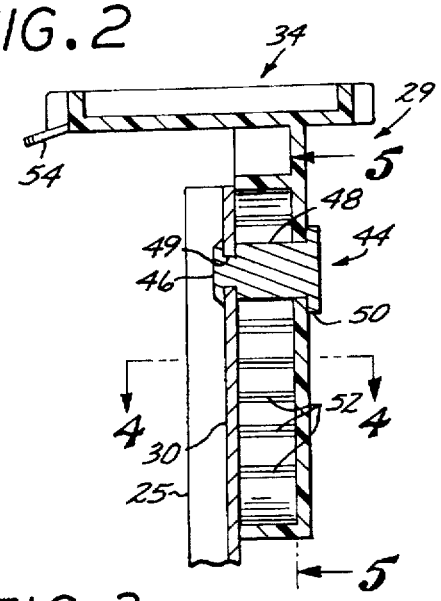
FIG. 2 is a cross-sectional view, in enlarged scale, taken along the line 2—2 of FIG. 1.
Figure 3:
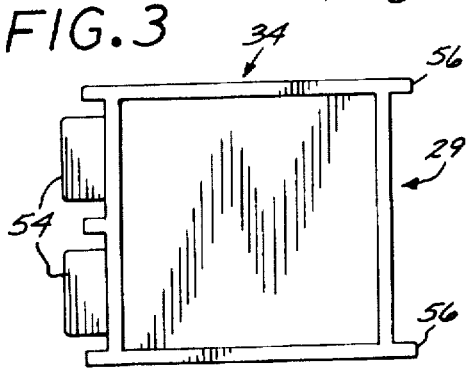
FIG. 3 is a top plan view, in enlarged scale, of the top guide shown in FIG. 1.

Referring to FIGS. 1 and 2, there is shown the top guide assembly 29 housed in the channel 27 and slidable therein for variable degrees of extension thereof from the upper end of the bracket housing 24. The top guide assembly includes a vertical, elongated stem 30 formed with a longitudinally extending slot 32. A mounting pin, generally designated 44, is fixedly connected to the bracket housing and projects outwardly through the channel 27 and serves to slidably mount the stem in the channel 27. The mounting pin is formed with an enlarged base 46 disposed behind the back wall 25 in abutting relationship therewith, a shank 48 which extends through an aperture 49 formed in the back wall and through the slot 32, and an enlarged head 50 for resting against the outwardly facing surface of the stem to securely and floatably house the stem in the channel and allow the stem to be displaced vertically therein.

Figure 5:
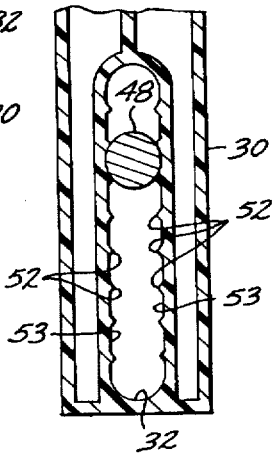
FIG. 5 is a fragmented cross-sectional view taken along the line 5—5 of FIG. 2.

Referring to FIGS. 2 and 5, the slot 32 is formed with a plurality of opposing, resilient, inwardly projecting ridges spaced a uniform distance apart along the opposite vertical sides of the slot. The ridges cooperate in adjacent pairs to define therebetween respective generally concave seats 53 for selective nesting of the shank 48 of the mounting pin therein. The shank is sized to make a close fit within the slot such that the ridges contact the shank and provide resistance to movement of the shank within the slot to thereby capture the shank therebetween so that it nests in one of the seats. Due to the deflectable, resilient nature of the ridges, this resistance can be overcome by applying sufficient force in a vertical direction upon the stem such that the stem may be moved vertically within the channel 27 to displace the shank relative to the slot. Once such force is no longer applied to the stem, the shank will again nest in one of the seats with the ridges acting to resist further relative movement thereof.

Connected to the upper end of the stem 30 is a generally square in cross-section follower, generally designated 34, for travel in an overhead track (not shown). The follower is sized for making a close fit within such track and includes a pair of spaced apart, outwardly projecting extensions 56 projecting from one side oft he follower, such extensions defining contact points for contacting the inner wall of the track. The follower further includes a pair of spaced apart, deflectable tabs 54 projecting generally horizontally outwardly from the opposite side of the follower. Thus the extensions 56 and tabs 54 serve to engage the opposite inner walls of the overhead track, with the deflectable tabs allowing for varying internal diameters of the track. Furthermore, the extensions provide two relatively small contact areas with the inner wall of the track. Thus the follower maintains contact with the opposite inner walls of the track during travel within the track, while the tabs and extensions provide a relatively small resistance to travel of the follower within the track.

It will be appreciated that the follower 34 could be formed having one enlarged or centrally formed tab rather than the two shown in the figures. In addition, the follower could be formed with a plurality of such tabs formed on diametrically opposite sides of the follower for deflectable engagement with both of the inner walls of the track.

Thus during displacement of the sliding door 15 and thus the follower 34 within the track, it will be appreciated that the follower will remain in contact with the opposite inner walls of the track and, as such, will prevent the sliding door from rattling or making undesirable noise. Even in situations where the inner diameter of the track varies slightly along the length thereof, the follower will remain in contact with the opposite inner walls of the track, as the tabs 54 will be deflected to a degree dictated by such inner diameter. Furthermore, the follower 34 is suitable for use in different tracks having varying inner diameters, as the tabs 54 will accommodate such varying diameters.

In addition, the top corner connector 12 of the present invention is suitable for use in doorways where the distance between the upper and lower tracks varies. Due to the adjustable connection of the stem 30 and housing 24, the degree of extension of the top guide assembly 29 from the upper end of the sliding door is readily adjustable simply by exerting a vertical force on the follower 34 to either raise or lower the follower to the degree dictated by the location of the upper track relative to the lower track. Thus, the top corner connectors 12 require minimal operator time in the event adjustment thereof is needed.

Referring to FIG. 1, there is shown a bottom corner connector assembly, generally designated 14. The bottom corner connector comprises a housing, generally designated 62, including a substantially planar, rectangular back wall 74 for abutting against the outer surface of the panel 16 and a pair of outwardly extending side walls 75 which are coextensive within the longitudinal length of the back wall. Connected to the upper end of the back wall is a horizontally and outwardly extending top wall 88. Thus the back wall, side walls, and top wall cooperate to define a downwardly opening channel 89.

Projecting laterally outwardly from the upper and lower ends of the housing 62 are respective pairs of mounting flanges 64 and 66. Each such mounting flange is formed with a bore (not shown) for registration with respective bores (not shown) formed in the stile 22 and lower rail 20 and threaded bores formed in the panel (not shown). Respective screws 65 and 67 are telescopically extended through the respective bores for engagement with the threaded bores formed in the panel 16. Thus the mounting flanges and screws serve to connect the bottom corner connector 14 to the sliding door assembly and further serve to fixedly connect the stile 22 and lower rail 20 to the panel.

Projecting laterally outwardly from the respective side walls 75 are respective generally E-shaped mounting clip assemblies, generally designated 68. The clip assemblies include arms 69 which project laterally outwardly from the respective side walls and then turn and extend upwardly. Connected to the upwardly projecting segments of the respective arms are pairs of spaced apart, resilient, laterally inwardly projecting curved clip fingers 70. As shown in FIG. 1, an aperture 77 is formed in the inwardly facing side wall of the stile 22 for extension therethrough of one of the clips. The curved clip fingers are resilient so as to flex during insertion of the clip through the aperture. Once the fingers are extended into the hollow interior of the stile, such fingers resume their normal curved configuration and engage the inner margin of the stile aperture 77 to securely connect the bottom corner connector to the stile. In the event it becomes necessary to remove the bottom corner connector, a user may insert a screwdriver or the like through the open bottom end 79 of the stile and manipulate the clip fingers out of engagement with the stile aperture margin to allow for removal of the clip from the aperture.

Connected to the bottom ends of the respective side walls 75 are a pair of anchor tab assemblies, generally designated 71, including laterally outwardly extending segments 72 and outwardly and upwardly angling anchor tabs 73 projecting from the distal ends of the respective outwardly extending segments. One of the anchor tabs is received in the open bottom end 79 of the stile 22 to securely connect the stile to the panel and hold the stile in place. The other anchor tab is received in a laterally extending slot (not shown) formed in the lower end of the lower rail 20. Thus the respective anchor tabs serve to further interconnect the stile, lower rail and panel.

The respective side walls 75 are further formed at their outer extremities with respective opposing, laterally inwardly extending flanges 76 indented at spaced apart locations on the outwardly facing surfaces thereof to form recesses 78 thereon and form beads or projections (not shown) on the inwardly facing surfaces thereof as more fully described below.

The bottom corner connector 14 further includes a roller assembly, generally designated 80, including a generally rectangular in cross-section roller housing 82 formed for sliding receipt in the channel 89. The roller housing is sized to make a close fit within the channel, with the beads formed on the inwardly facing surfaces of the respective flanges 76 engaging the roller housing to provide a resistance to movement of the roller housing within the channel. The housing includes a downwardly opening lower end in which is rotatably mounted a wheel 84 on an axle 85 and which extends downwardly from the lower end of the housing for travel in a lower track (not shown).

The top wall 88 of the bottom corner connector 14 has formed generally centrally on the downwardly facing surface thereof a boss 90 including a threaded through bore (not shown) for extension therethrough of a threaded adjustment screw 92. The screw is further extended through a bore (not shown) formed in an in-turned guiding flange 86, the flange being formed from a cut-out of the back wall 74. The bottom end of the screw engages the top end of the roller housing 82. Thus, the roller housing may be easily and efficiently extended from the bottom end of the bottom corner connector 14 by merely adjusting the adjustment screw. It will also be appreciated that the adjustment screw maintains the wheel extended from the bottom corner connector and does not allow the roller assembly to be forced up into the housing due to the weight of the sliding door.

In use, a work person takes an assembled sliding door 15 comprising a panel 16, a pair of rails 18 and 20, and a pair of vertical stiles 22. The work person then takes a pair of top corner connectors 12 of the present invention and inserts the clips 40 and anchor tabs 38 and 39 into the respective slot and apertures formed in the stiles and upper rail. The screws 35 are then threadedly engaged with the bores formed in the panel to securely interconnect the panel, stiles and upper rail.

The work person then takes a pair of bottom corner bracket assemblies 14 and inserts the clips 68 and anchor tabs 71 into the respective slots and apertures formed in the stiles 22 and lower rail 20. The screws 65 and 67 and then threadedly engaged with the bores formed in the panel to mount the bottom bracket assemblies to the sliding door 15 and securely interconnect the panel, stiles and lower rail.

The sliding door 15 is then installed in a track assembly, with the wheels 84 of the bottom corner connectors 14 riding in the lower track and the followers 34 of the top corner connectors 12 disposed in the upper track for displacement therewithin. In the event the followers require vertical adjustment in order to be disposed at the proper height for receipt in the upper track, the work person may simply pull or push on the followers as required to either further extend the followers from the sliding door or retract such followers to the required extent.

With the wheels 84 riding in the lower track and the followers 34 disposed in the upper track, the sliding door is ready for use. During use of the sliding door, the deflectable tabs 54 and extensions 56 cooperate to remain in contact with the opposite inner walls of the upper track as the sliding door is displaced therealong, with the extensions engaging one of such inner walls and the deflectable tabs engaging the opposite such inner wall. Thus, in the event the lower track is not perfectly level or straight, the tabs and extensions will remain in contact with the inner walls of the upper track and will not allow the follower to be rattled within the upper track and generate a disturbing noise during displacement of the sliding door.

From the foregoing, it will be appreciated that the top guide and bottom bracket assembly of the present invention provides an efficient, adjustable assembly for interconnecting the stiles, rails and panel of a sliding door and which provides a top guide which eliminates or substantially reduces any rattle and attendant noise during use of the sliding door. Furthermore, the top guide assembly is readily adjustable to accommodate track assemblies of varying heights.

While a particular form of the present invention has been illustrated and described, it will also be apparent that various modifications can be made without departing from the spirit and scope of the invention. Accordingly, it is not intended that the invention be limited, except as by the appended claims.

What is claimed is:

1. A sliding door and adjustable guide assembly for travel in an upper track, said sliding door including a panel having respective upper and lower ends and further having opposite sides, a pair of horizontally extending rails engaged with said panel at said respective upper and lower ends of said panel, and a pair of vertically extending stiles, having respective upper and lower ends, engaged with said panel at said opposite sides thereof, said assembly comprising:

at least one bracket assembly, having an upper end, and configured for mounting to said panel adjacent said upper end thereof and including a bracket housing having an upper end and respective opposite sides; and a top guide assembly comprising a vertical stem slidably engaged with said bracket housing for displacement of said stem relative to said bracket housing and a follower assembly including a body connected to said stem and sized for making a close fit in said upper track, said follower assembly further including at least one deflectable tab extending outwardly from said body for deflectable engagement with an inner wall of said upper track.

2. A sliding door and guide assembly as set forth in claim 1 wherein:

said follower assembly includes a pair of spaced apart, deflectable tabs extending outwardly from said body.

3. A sliding door and guide assembly as set forth in claim 1 wherein each of said stiles is formed with one or more apertures at predetermined locations therein and defining one or more inner margins and further including:

at least one clip extending outwardly from said bracket housing for telescopic extension through one of said apertures, said clip including a plurality of curved, deflectable anchoring fingers, each of said fingers for engagement with one of said inner margins of said aperture.

4. A sliding door and guide assembly as set forth in claim 1 wherein:

said bracket housing is formed with an upwardly and outwardly opening vertical channel and further including:

a mounting pin including a first end connected to said bracket housing at a predetermined position and a midsection extending through said channel, said pin further including a second end formed with an enlarged head and wherein:

said vertical stem includes a longitudinal slot for extension therethrough of said midsection, said stem further including a plurality of spaced apart, opposed ridges defining a plurality of indentations for selective nesting of said midsection therein.

5. A sliding door and guide assembly as set forth in claim 1 wherein each of said stiles is formed with an open upper end and further including:

at least one anchor tab connected to said upper end of said bracket housing and angling outwardly and downwardly therefrom for receipt in said open upper end of said stile to securely connect said stile to said panel.

6. A sliding door and guide assembly as set forth in claim 1 wherein:

said follower assembly is formed of nylon.

7. A sliding door and guide assembly as set forth in claim 1 and further including:

a pair of mounting flanges extending laterally outwardly from said opposite sides of said bracket housing for connection with, respectively, one of said stiles and one of said rails.

8. A sliding door and guide assembly as set forth in claim 1 wherein said rails are formed with upwardly opening, spaced apart slots therein; and said bracket assembly includes at least one outwardly and downwardly projecting anchor tab at said upper end thereof for telescopic extension through one of said slots.

9. A sliding door and guide assembly as set forth in claim 1 wherein:

said guide assembly comprises a pair of spaced apart bracket assemblies connected to said sliding door and a pair of top guide assemblies engaged with the respective said bracket assemblies.

10. A sliding door assembly, having a top guide and bottom bracket assembly, and including a panel having upper and lower ends and two opposite sides, said upper and lower ends meeting with said opposite sides to form two upper corners and two lower corners respectively, upper and a lower horizontal rails engaged with said panel at said upper and lower ends of said panel respectively, and a pair of vertical stiles engaged with said panel at said opposite sides thereof for travel in an upper and lower track, said assembly comprising:

a pair of top bracket assemblies, having upper ends, and disposed adjacent said upper corners of said panel, each said top bracket assembly including a bracket housing connected to said upper rail, one of said stiles, and said panel, and further including a top guide including a vertical stem having an upper end slidably engaged with said bracket housing and a follower assembly including a body connected to said upper end of said stem and sized for making a close fit in said upper track, said follower assembly further including at least one deflectable tab extending generally horizontally outwardly from said body for deflectable engagement with an inner wall of said track; and a pair of bottom bracket assemblies disposed adjacent the lower corners of said panel, each said bottom bracket assembly including a generally channel shaped bottom bracket housing connected to said lower rail, one of said stiles, and said panel, and further including a roller assembly slidably received in said channel shaped housing and rotatably mounting a wheel for rolling engagement with said lower track.

11. A sliding door assembly as set forth in claim 10 wherein:

said follower assembly includes a pair of spaced apart, deflectable tabs extending outwardly from said body.

12. A sliding door assembly as set forth in claim 10 wherein said stiles are formed with apertures at predetermined locations therein each aperture defining an inner margin and further including:

at least one clip extending outwardly from said bracket housing for telescopic extension through one of said apertures, said clip including a plurality of curved, deflectable anchoring fingers for engagement with said inner margin of said one of said aperture.

13. A sliding door assembly as set forth in claim 10 wherein:

said bracket housing is formed with an upwardly and outwardly opening vertical channel and further including:

a mounting pin including a first end connected to said bracket housing at a predetermined position and a midsection extending through said channel, said pin further including a second end formed with an enlarged head and wherein:

said vertical stem includes a longitudinal slot for extension therethrough of said midsection, said stem further including a plurality of spaced apart, opposed ridges defining a plurality of indentations for selective nesting of said midsection therein.

14. A sliding door assembly as set forth in claim 10 wherein each of said stiles is formed with an open upper end and further including:

at least one anchor tab connected to said open upper end of said bracket housing and angling outwardly and downwardly therefrom for receipt in said open upper end to securely connect said stile to said panel.

15. A sliding door assembly as set forth in claim 10 wherein:

said follower assembly is formed of nylon.

16. A sliding door assembly as set forth in claim 10 and wherein:

said bracket housing has opposite sides, and further including;

a pair of mounting flanges extending laterally outwardly from said opposite sides of said bracket housing for connection with, respectively, one of said stiles and one of said rails.

17. A sliding door assembly as set forth in claim 10 wherein said rails are formed with upwardly opening, spaced apart slots therein; and said bracket assembly includes at least one outwardly and downwardly projecting anchor tab at said upper end thereof for telescopic extension therethrough one of said slots.

* * * * *